US005429160A

United States Patent [19]

Bardroff et al.

[11] Patent Number: 5,429,160

[45] Date of Patent: Jul. 4, 1995

[54] FILLING APPARATUS FOR CYLINDRICAL CONTAINERS

[75] Inventors: Hans Bardroff, Hohenroth; Guenter Brosch, Wollbach, both of Germany

[73] Assignee: Preh Industrieausruestungen GmbH, Saale, Germany

[21] Appl. No.: 230,827

[22] Filed: Apr. 21, 1994

[30] Foreign Application Priority Data

Apr. 24, 1993 [DE] Germany ..... 43 13 449.1

[51] Int. Cl.[6] ..... B65B 1/20; B65B 1/28

[52] U.S. Cl. ..... 141/72; 141/268; 141/391; 209/920; 221/192; 198/757; 198/391

[58] Field of Search ..... 141/72, 74, 75, 391, 141/267, 268; 209/539, 690, 920; 221/192, 167; 198/757, 391; 366/108, 110, 111, 114; 53/525

[56] References Cited

U.S. PATENT DOCUMENTS

| | | | |
|---|---|---|---|
| 720,053 | 2/1903 | McKibben | 141/72 |
| 1,635,160 | 7/1927 | Bergmann | 141/267 |
| 2,549,322 | 4/1951 | McKinsey | 53/525 |
| 3,027,694 | 4/1962 | Adler | 141/74 |
| 3,313,410 | 4/1967 | Gardner | 209/920 |
| 3,587,672 | 6/1971 | Meinch | 141/74 |
| 4,462,508 | 7/1984 | Grafius | 209/920 |

FOREIGN PATENT DOCUMENTS

| | | |
|---|---|---|
| 2240811 | 3/1970 | Germany . |
| 3731749 | 4/1988 | Germany . |

*Primary Examiner*—J. Casimer Jacyna
*Assistant Examiner*—Steven O. Douglas
*Attorney, Agent, or Firm*—Griffin, Butler Whisenhunt & Kurtossy

[57] ABSTRACT

A filling apparatus for cylindrical containers densely fills the containers with, for example, granularly-shaped fill material by causing a container to be set into a shaking rotation by rotationally oscillating a container retainer.

7 Claims, 1 Drawing Sheet

FILLING APPARATUS FOR CYLINDRICAL CONTAINERS

BACKGROUND OF THE INVENTION

This invention concerns apparatus for filling cylindrical containers with materials having fixed shapes, such as granular or tablet-shaped fill material, whereby the containers stand in retainers while fill material, that is conveyed by a conveyor, falls thereinto in doses.

It is known to fill containers in an uncomplicated manner by pouring the fill materials into the containers. Depending on need, filling aids, such as funnels, make this filling process easier. The fill material spreads out randomly in the containers during the filling so that bridge formations can arise such that one container could receive various quantities of fill material.

By use of a conveyor, with appropriate equipment, one can convey the fill material to the container in doses, or dosed amounts. Oscillating, or reciprocating, conveyors with linear or circular conveying stretches are particularly well suited for this. The thusly apportioned and conveyed fill material can spread out better in the container, but a uniform, dense filling is not guaranteed.

In this regard, the amount of fill material can be critical, as in the case of a activating charge for an inflatable sack. Inflatable sacks are installed in motor vehicles for protecting passengers thereof. When there is an accident with a motor vehicle a reaction is initiated in the activation charge so as to effect a sudden filling of the sack, which is folded together, by a gas. The activating charge comprises a container filled with tablets. A fill amount of the container determines the amount of gas, with a fill density and a tablet-shape influencing the course of the reaction as a function of time. The container is sized such that when it is densely filled it contains a particular amount of tablets. The filled condition of the container must be maintained during use of the motor vehicle. Upon a subsequent loosening of the tablets caused by shaking of the motor vehicle, the tablets rub against one another and pulverize. The course of the reaction as a function of time is thereby unfavorably influenced.

A uniform and/or densely filled condition, as is necessary for such applications, cannot be obtained, without further measures, by known apparatus. This can particularly not be guaranteed when inconvenient shapes or objects in the interior of the container, such as bothersome surfaces, hinder the filling process.

It is therefore an object of this invention to provide an apparatus of the type described in the introductory paragraph above that densely fills containers in an uncomplicated manner with granulate, tablets, and the like, even if bothersome surfaces in the container hinder distribution of the fill material.

SUMMARY OF THE INVENTION

According to principles of this invention, a receiver of the apparatus oscillates with rotary motion and imparts a shaking rotational movement to a container being filled.

BRIEF DESCRIPTION OF THE DRAWING

The invention is described and explained in more detail below using the embodiments shown in the drawing. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawing. The drawing is not necessarily to scale, emphasis instead being placed upon illustrating principles of the invention in a clear manner.

DESCRIPTION OF PREFERRED EMBODIMENT

Figure 1:
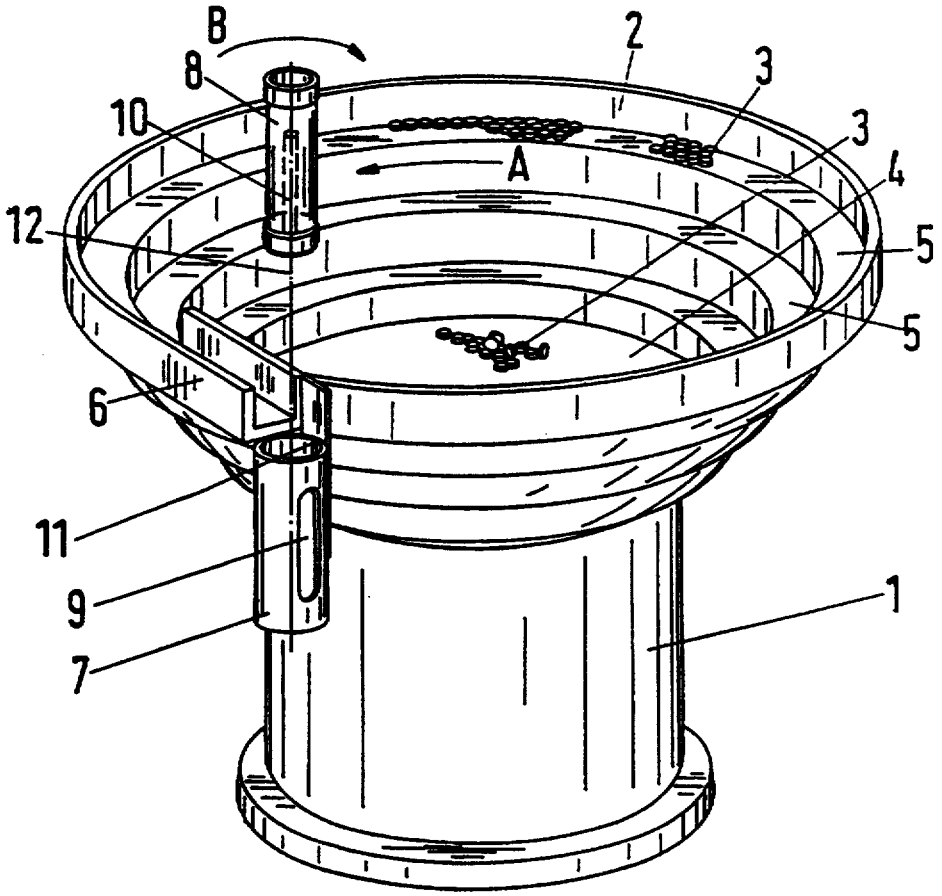
FIG. 1 depicts an exploded, isometric view of a filling apparatus of this invention with a cylindrical container.

The single drawing depicts an apparatus with an oscillating, or reciprocating, conveyor. A cylindrically shaped base part 1 supports a funnel-shaped fixture 2. The fixture 2 serves as a supply container for filling tablets 3. A pivot drive (not shown in the drawing) arranged inside the base part 1 is coupled to the fixture 2 and causes this to oscillate, or reciprocate rotationally. A conveyor track 5 winds around an interior wall of the fixture 2, snake-like, from a floor 4 of the fixture up to an outlet 6. The tablets 3 move in an arrow A direction along the conveyor track, driven by the oscillations of the fixture 2. The tablets 3 are separated and, as necessary, sorted, on the conveyor track 5. At the end of the conveyor track 5 the tablets 3 fall from the outlet 6 of the conveyor. The number of tablets which fall out can be dosed, or apportioned, depending on an arrangement of the conveyor track 5 and adjustment of the oscillating drive. On an outer edge of the fixture 2, aligned with the outlet 6, a cup-shaped receiver 7 for a cylindrical container to be filled is flange mounted. A sight window 9 is in a wall of the cup-shaped receiver 7. The filling of the container 8 can be watched through the sight window 9.

The container 8 sits, contrary to the representation in the drawing, inside the cup-shaped receiver 7. In the interior of the container 8 a concentrically extending pipe part 10 forms a disturbing, or bothersome, surface. This bothersome surface makes it difficult to densely fill the container 8 with the tablets 3. The contents of the container 8, during use, can be influenced by the pipe part 10.

The cylindrical container stands in the receiver 7 to be filled. Oscillating movements of the fixture which transport the tablets 3 in the arrow A direction to the outlet 6 imparts movement via the attachment flange to the outer edge 11 of the cup-shaped receiver 7. Because of the side attachment of the edge 11 of the receiver 7, the rotational oscillation movement of the fixture 2 leads to an opposite rotational oscillation movement of the receiver 7. This movement is transmitted in the receiver 7 to the container 8 and causes the container 8 to shakingly rotate about its axis 12 in a direction of arrow B, opposite to the direction of arrow A. With an appropriate arrangement of the receiver 7, as well as the container 8 and the outlet 6, the tablets 3, which are conveyed in doses on the conveyor track 5, fall in the shakingly rotated container 8 away from the axis 12. The tablets which fall into the container 8 in doses can, because of the shaking rotation of the container, distribute themselves and at the same time orient themselves to be aligned with one another. The container can be densely filled layer after layer whereby tablets which lie on top of one another often form columns. After this filling process, the container 8 is removed from the receiver 7 and a container mouth opening is closed by a cap (not shown) for use.

With appropriate arrangement of the conveyor outlet and container receiver near the rotational axis of rotating container, the fill material, which is apportioned and transported by the conveyor, falls into an appropriately large filling opening of the containers. In this regard, since fill material distributes itself for the continually changing container portions; a local piling up of the fill material is avoided. The shaking movement of the container promotes an exact distribution. When this is done, because there is no piling up, bridge build-ups are reduced or prevented. The individual pieces of the fill material lie together in mutual, or opposite, orientations. Tablet-shaped particles form adjacent columns as filling advances so that loose, intermediate, spaces are almost totally absent. Thus, a maximized final density is achieved.

In the filling apparatus of this invention, the filling material is apportioned, or dosed, by a conveyor to a fill opening of the container and then falls directly into, or as necessary also through a funnel into, the container. The conveyor can, for example, be a snail-shape conveyor, band conveyor, oscillating conveyor, or any other known conveyor. The choice of the conveyor to be used depends on its suitability for the conveyed fill material. It is important above all, that it can apportion, or dose, while conveying.

With the suggested overall apparatus of this invention, the container is on, or in, a rotationally oscillating receiver. The receiver can be an independent device arranged with a drive for causing the rotational oscillations. In a beneficial embodiment the conveyor is a lengthwise, or circularly transporting oscillating conveyor. In this regard, the receiver is arranged at the outlet of the oscillating conveyor and is attached so that its oscillating movements are transmitted to the periphery of the rather rigid receiver and thereby causes rotational oscillations. The oscillating drive of the conveyor is, in this arrangement, also, at the same time, the drive for the rotational oscillations of the receiver.

The conveyed amount and the filling process can be independently influenced by the drive of the oscillating conveyor depending on the type of construction of the filling apparatus. In one embodiment of the invention, there is a replaceable, or exchangeable, receiver. In this manner, the overall device can be used with containers of various width. According to a further embodiment of the invention, the container to be filled is reliably held in the cup-shaped receiver and accordingly it is easy to replace. The filling process can be easily monitored through a sight window in the wall of the cup-shaped receiver.

The embodiments of the invention in which an exclusive property or privilege are claimed are defined as follows:

1. Apparatus for filling a cylindrical container with materials having fixed shapes, such as granular or tablet-shaped fill material, comprising a receiver for holding the cylindrical container and a conveyor for dosing the fill material into the cylindrical container by letting it fall thereinto;

wherein the apparatus further includes a means for oscillating the receiver rotationally and thereby setting the container into a shaking rotation;

wherein the conveyor is an oscillating conveyor and said means for oscillating the receiver oscillates said oscillating conveyor which, in turn, causes rotational oscillations of the receiver; and wherein the receiver is attached at an outer periphery of the oscillating conveyor.

2. Apparatus as in claim 1 wherein an oscillating performance of the drive of the oscillating conveyor is adjustable.

3. Apparatus as in claim 1 wherein the receiver can be replaced.

4. Apparatus as in claim 1 wherein the receiver is cup-shaped.

5. Apparatus as in claim 1 wherein the receiver has a sight window therein.

6. Apparatus as in claim 1 wherein the container rotates about an axis and the fill material falls into the container away from an axis thereof.

7. Apparatus for filling a cylindrical container with materials having fixed shapes, such as granular or tablet-shaped fill material, comprising a receiver for holding the cylindrical container and a conveyor for dosing the fill material into the cylindrical container by letting it fall thereinto;

wherein the apparatus further includes a means for oscillating the receiver rotationally and thereby setting the container into a shaking rotation; and wherein the receiver has a slight window therein.

* * * * *